US006179054B1

(12) United States Patent
Stewart

(10) Patent No.: US 6,179,054 B1
(45) Date of Patent: Jan. 30, 2001

(54) DOWN HOLE GAS SEPARATOR

(76) Inventor: Robert G Stewart, P.O. Box 708, Andrews, TX (US) 79714

( * ) Notice: Under 35 U.S.C. 154(b), the term of this patent shall be extended for 0 days.

(21) Appl. No.: 09/127,385

(22) Filed: Jul. 31, 1998

(51) Int. Cl.[7] ..... E21B 43/00
(52) U.S. Cl. ..... 166/105.5; 166/265
(58) Field of Search ..... 166/105.5, 265; 96/220

(56) References Cited

U.S. PATENT DOCUMENTS 1,697,321 * 1/1929 Marsh .
2,748,719 * 6/1956 Wells .
4,074,763 * 2/1978 Stevens ..... 166/325
4,366,861 * 1/1983 Milam ..... 166/105.5
4,486,203 * 12/1984 Rooker .
4,515,608 * 5/1985 Clegg ..... 62/475
4,531,584 * 7/1985 Ward ..... 166/265
4,755,194 * 7/1988 Rooker et al. .
5,201,195 * 4/1993 Gavlak et al. ..... 62/475
5,431,228 * 7/1995 Weingarten et al. ..... 166/357
5,482,117 * 1/1996 Kolpak et al. ..... 166/265
5,482,542 * 1/1996 Ballijnger ..... 96/204
5,525,146 * 6/1996 Straub ..... 96/214
5,653,286 * 8/1997 McCoy et al. ..... 166/105.5

* cited by examiner

*Primary Examiner*—David Bagnell
*Assistant Examiner*—Jennifer R. Dougherty
(74) *Attorney, Agent, or Firm*—Bracewell & Patterson, L.L.P.

(57) ABSTRACT

A slotted gas separator for a down hole pump has an internal baffle that is angled to push the oil down into the chamber and the gas up to be released. The baffle has a roughened surface area with small, grainy protrusions that result in a jagged, coarse surface to agitate the liquid-gas mixture and separate out any gas. The large surface area of the baffle insures maximum contact to separate the oil and gas. The gas is released through slots on the top of the casing.

7 Claims, 2 Drawing Sheets

DOWN HOLE GAS SEPARATOR

BACKGROUND OF THE INVENTION

Field of the Invention

The present invention is generally related to improvements in a downhole gas separator and is more specifically directed to a slotted gas liberation system and a rough surface baffle to separate fluid and gas.

In the initial stages of oil production, the downhole well pressure is sufficient to force the well fluid upward. However, the reservoir pressure substantially decreases as fluids are removed. Once the pressure drops below a certain minimum level, the fluids must be elevated artificially. Typically, such low pressure wells utilize downhole pumping units for artificial lift and elevation of fluids. The most common downhole pump is a two-cycle downhole rod pump, and this is sometimes referred to as a "sucker rod." The pump uses two cycle sucker rods and a simple piston, and is driven by a surface pumping unit. On the upstroke, fluid is lifted up and removed. On the downstroke, the valve or piston is returned to the bottom of its stroke. Often, a perforated gas separator is attached to the pump to separate the oil and gas and to ensure that only oil is lifted up.

It is very important to elevate the fluid and not the gas, because unwanted gas in the pump can cause major problems. First, the presence of gas in the pump decreases the volume of oil transported to the surface, since the gas takes up space that could be occupied by liquid. Therefore, gas in the pump decreases the efficiency of oil production. The second major problem with gas flowing into the pump is the possibility of a resulting condition known as gas-lock. If a barrel is completely filled with gas, it may never reach the pressure needed to open the traveling valve or raise the piston. This means that oil fluids cannot enter the barrel, and that the gas inside the barrel cannot get out. Thus, a "gas-locked" situation results, because for stroke after stroke, no liquid enters or leaves the pump. Gas lock is such a common phenomenon in sucker rod pumps that many wells cannot be produced because they contain too much gas.

The final major problem with gas entering the pump is that when the liquid is pumped up, there can only be a limited amount of gas in the pump before operational problems will develop that can result in severe damage to the pumps. This problem is usually called gas pounding. The light gas propels the heavy liquid forward. The forced pounding of liquid against the inner walls which results can severely damage the sucker rods and slowly disfigure the pump. When this happens, the whole pumping unit has to be removed out of the ground for repair and readjustment, and this decreases fluid recovery efficiency. Usually, a spiral segregator, a baffle plate, or some variation thereof is incorporated into the design of the down hole pump to decrease the amount of gas inside the pump at any given time. Typically, the amount of gas in the pump inlet's fluid flow stream can not exceed about fifteen percent by volume without damage. Thus, pumps are much more efficient in a gas free environment.

Gas separators are traditionally used to avoid these three problems, and several designs are currently in use. Often, a gas lock problem is avoided by lowering the traveling valve so that a higher compression ratio is obtained in the pump. This forces pump action more frequently since the traveling valve will open both when it hits the liquid in the pump, and also when the pump pressure is greater than the pressure above the traveling valve. If the valve is forced open more often, the pump can release more gas and take in more oil. The flaw in this technique is that it does not increase the gas separator efficiency. If the gas and liquid that enters does not separate properly, then regardless of the increased efficiency of the pump's ability to take in larger volumes, gas can still interfere with the pumping of oil to cause gas lock or gas pounding.

In order to prevent this from happening, U.S. Pat. No. 2,969,742 to Arutunoff, issued Jan. 31, 1961 discloses a motor-driven, reverse flow-type liquid-gas separator. Other examples of such motor-driven rotating type gas-liquid separators are described in U.S. Pat. No. 4,481,020 to Lee on Nov. 6, 1984 and U.S. Pat No. 4,981,175 to Powers on Nov. 6, 1984. The fluid is forced to undergo reverse flow along a spiral or helical flow path so that, in effect, there is a centrifuging of the liquid-gas mixture to separate them. Because the reverse flow technology is motorized, this type of separator consumes additional power due to work exerted to separate and lift the liquid, and thus is not very efficient.

U.S. Pat. No. 5,482,117 to Schoeppel granted Jan. 9, 1996 discloses a gas separator that has been developed to solve this efficiency problem by using centrifugal forces to separate the gas and liquid without a motor. This gas separator device consists of a stationary helical baffle within tubular housing that redirects gas flow in a non-natural direction. The baffle is placed within a conventional downhole pump, and because it is stationary, it does not consume any additional power. The liquid is forced to the outer wall, and the gas is forced into a flow path that takes it to the surface. Since the baffle surface area of each twist of the helix is not very large and surface contact with the solution is not that high, there is reliance on the centrifugal forces to separate the oil and gas. When the gas is finally released, it is liberated through tiny, little holes called perforations. Although a non-motorized gas separator is more efficient than a motorized one, there is still a gas lock problem that remains to be solved. The tiny holes can get plugged up with gas bubbles upon exit can prevent oil entry.

A similar helical spiral ramp was disclosed in Ward's U.S. Pat. No. 4,531,584 granted on Jul. 30, 1985. This gas separator provides continuous upwardly spiraling separating velocity to the entering oil and gas in order to separate at least enough gas to reduce gas lock. The gas separator relies on the continuous flow separation velocity to direct the separated oil to the oil flow outlet and the separated gas to the gas flow outlet. The internal collection tube includes a series of openings which allow for the migration of gas radially inward. The gas is then directed upward and released through small outlets. These holes can also prevent fluid entry and thus result in a decrease of oil recovery if plugged up by gas bubbles in a gas lock condition.

Since the U.S. Pat. No. 1,697,321 granted to Marsh on Jan. 1, 1929 began the trend, all the devices patented thus far have disclosed holes for fluid entry/exit openings. Recent technology disclosed in U.S. Pat. No. 5,653,286 to Schoeppel granted Aug. 5, 1997 is no exception. The apparatus is an elongated vessel that is closed on one end. It contains fluid inlets and gas vents on top that extend through the side walls. The fluid inlets are used to capture the rising fluid as it enters so that the gas separates and is forced to exit the interior chamber through the vents above. There is also a second chamber below the interior that has an opening to release gas in case any gets collected there. The longer, lower end of the tubular body with the fluid inlets is cut at an angle, and the upper end of the gas separator has an angled deflector. A deflector is a flexible spring steel that is welded to the separator and is mounted on the opposite sides of the fluid inlet. The angled deflector forms wide and narrow flow regions the help separate the liquid and the gas. The liquid tends to collect on the casing to be pushed down and the gas tends to be forced up to the more open region. However, even in this, the most current of technology, two problems remain. First, the gas is still exiting through small holes that can get plugged by gas bubbles. Secondly, the use of a smooth baffle as a gas separator is not an efficient baffle system, so the problems of gas pounding and the resulting decreased productivity remain.

SUMMARY OF THE INVENTION

In the present invention, a slotted gas separator with a tubular shaped body, large slots, and an angled internal baffle strike plate with artificial roughness is installed below the seating nipple in a down hole pump. The slots allow the oil to advance into the casing and continue freely through to the chamber, even though there may be some gas bubbles present. The use of slots solves a long standing problem in the industry because it significantly decreases the risk of gas bubbles plugging the entrance holes and blocking oil entry. That is, the slots solve the gas bubble blockage problem that prevents oil from entering the casing. This eliminates a major problem experienced with the holes and perforations that are currently used in almost all downhole pumps.

Use of slots for gaseous liberation is very effective, because unlike with holes or perforations, the gas bubbles go straight through and thus there is far less risk of blockage that will result in gas-lock or decreased oil production. In typical installations, the separator has a capacity that is twice the pump capacity, so pump down time will be significantly decreased.

With this invention, as the gas-fluid solution enters the casing, it hits a baffle plate that is welded into the tubing at an angle intersecting the tubing axis. This baffle plate redirects the gas and forces it into an upward path. The baffle compels the fluid to fall down into the chamber of the tubing, and drives the gas up to escape out of the slots located at the top of the casing. Thus when the fluid-gas mixture hits the plate, there is a separation that takes place. Fluid is pulled down into the chamber by gravity because of its heavier weight, and the gas, which is very light, exits out into the casing and dissipates out into the environment. This separation minimizes the possibility of gas pounding by preventing the gas from entering the pump.

The rough surface of the baffle strike plate is used to irritate, agitate and finally separate out any gas molecules that may remain in the solution and release them through the slots. It agitates the liquid to force further separation. A rough surface is especially effective because it increases the surface area that can come in contact with the solution. Once oil alone is in the lower chamber, it is pumped up to the surface in the usual manner. The oil is artificially lifted upward to the surface for recovery. This design allows for an increased efficiency in oil production, reduces the formation back pressure, reduces the operational down time, and improves pump displacement efficiency.

It is an object and feature of the subject invention to provide an invention that decreases gas lock by its slots that allow gas to exit.

It is also an object and feature of the subject invention to decrease pump down time by minimizing gas pounding through a more efficient liquid-gas separation process.

It is a further object and feature of the subject invention to increase fluid production by approximately 30% per pump recovery cycle.

Those skilled in the art will recognize the above-mentioned advantages and features of the present invention together with other features of the present invention, together with other superior aspects thereof upon reading the detailed description which follows in conjunction with the drawings.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE PREFERRED EMBODIMENTS

Figure 1:
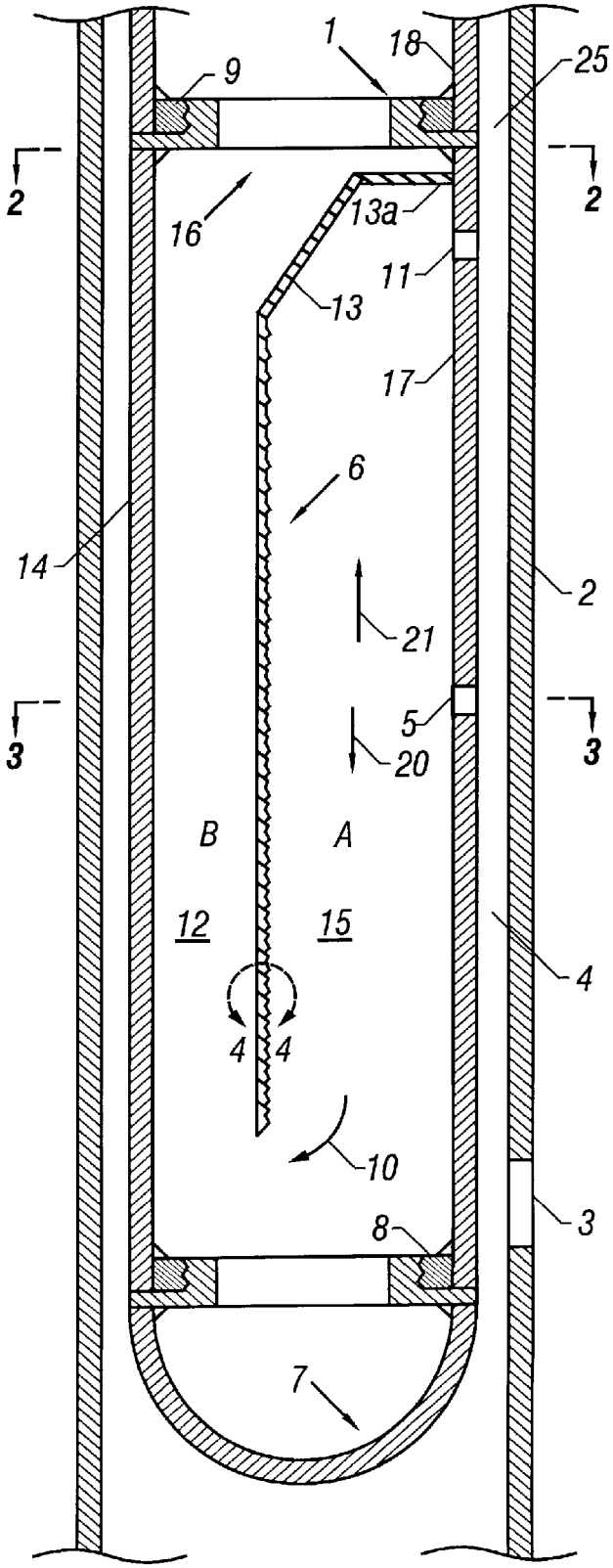
FIG. 1 is an elevation, section view of the slotted gas separator.

The slotted gas separator of the present invention is a device which is insertable into a production tubing string at the lower end of a standard downhole pump for separating oil and gas. Referring to FIG. 1, the slotted gas separator is generally designated by the numeral 1, which is enclosed in the conventional production casing or tubing 2. In the embodiment shown, the separator 1 is made of three inch pipe (outer diameter) 14 and extends lengthwise for twelve feet. The separator 1 is attached to the downhole pump 18 by a two and seven-eighths inch collar 9 that is welded to the pipe 17 and the upper end of the separator 16. In the preferred embodiment, the separator pipe is closed off at the bottom by a bull plug 7 which is two and seven-eighths inches wide and fits neatly inside the pipe 17. The bull plug, 7, is held in place by the collar 8 that is welded to the pipe.

Figure 2:
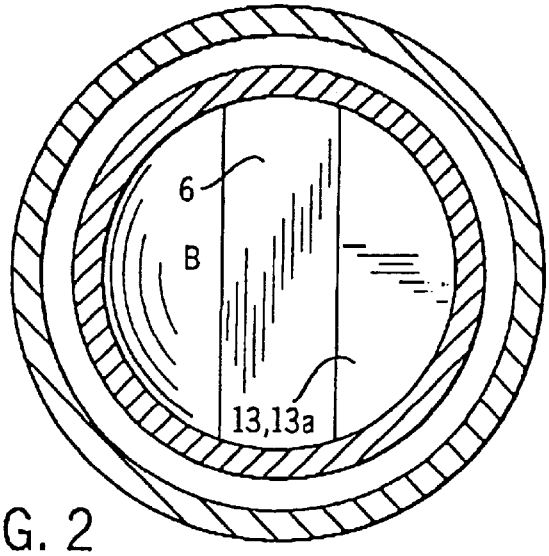
FIG. 2 is a cross section view taken along line 2—2 of FIG. 1.
Figure 3:
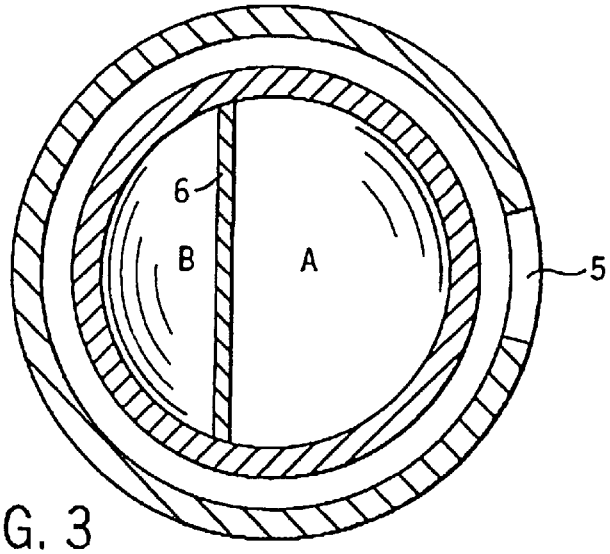
FIG. 3 is a cross section view taken along line 3—3 of FIG. 1.

The casing 2 is perforated at 3 to allow the liquid-gas mixed phase solution to enter from the ground. The space between the separator and the casing comprises two general regions, an upper space 25 located generally above the slot 5 and a lower space 4 located generally below the slot 5. The solution flows through the lower space 4, and enters the separator 1 through the slot 5. In the preferred embodiment, the slot 5 is one inch wide, and it is large enough to let through any gas bubbles that may be in the mixture. The slot 5 is clearly visible in FIG. 3. Once the mixed-phase solution enters through slot 5, it hits the welded baffle 6. As shown in FIGS. 1–3, it is impossible for the solution to avoid contact with the baffle since it extends from one end of the separator to the other.

Figure 4:
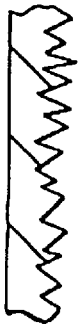
FIG. 4 is a fragementary view, enlarged for clarity, taken at 4—4 of FIG. 1.

An overall view of this concept is obvious when examining FIG. 1 again. Once the gas-liquid mixed phase solution has entered the separator, it is subjected to separation upon hitting the rough surface baffle 6. The angled baffle 6 spans the entire interior diameter of the slotted gas separator pipe, so it is wall-to-wall. Referring now to FIG. 3, it can be seen that the baffle separates the separator into two chambers, A and B, because the baffle spans the entire diameter of the cross-section. As shown in FIG. 1, the baffle 6 is 75% of the total length of the slotted gas separator 1 or eight feet in the preferred embodiment. The large surface area of the baffle insures maximum contact to separate the oil and gas. As best shown in FIG. 4, the baffle has a unique roughness with small, grainy protrusions that result in a jagged, coarse surface that is similar to sandpaper in order to agitate the liquid-gas mixture. It separates any gas that may be present from the liquid oil. Once separated, oil is sent down one flowpath in chamber A (see arrow 20) while the separated gas percolates upward (see arrow 21) and out through slot(s) 11. The oil flows under the end of the baffle 6 (see arrow 10) and into chamber B for recovery by the usual means.

The released gas flows upward to the top of the separator 1 for release through slot 11 and enters the upper space 25 between the separator 1 and the casing 2. Use of slots for gaseous liberation is very effective, because unlike with holes or perforations, the gas bubbles go straight through and thus there is no risk of blockage that will result in gas-lock or decreased oil production. Once in this cavity passage the gas will be released and will dissipate into the environment. It will be noted that angle plates 13 and 13*a* close the top of the separator off from chamber A.

The heavy liquid molecules will have a gravitationally created flowstream (arrow 20) that will push down the fluid into the chamber space 15 at arrow 10, causing a fluid seal between chambers A and B. Once it hits the bottom of the bull plug 7, the liquid will be forced up behind the baffle plate as indicated at 12. This opposite side of the baffle plate 6 is relatively smooth, since all the gas bubbles have already been separated. This smoothness increases efficiency of oil retrieval, because with a smooth surface, pure oil is able to race up to the surface faster. Tests on the preferred embodiment have shown a 30% increase in fluid production when using a slotted gas separator over separators of similar construction using holes instead of slots and a smooth baffle plate.

Once the oil has been separated and is in the pure fluid area 12 of chamber B, it is ready to be lifted up to the surface. The separator 1 is attached to the downhole pump 18 by a two and seven eighths inch collar 9 that is welded to the pipe and pump. Downhole pumps generally use either pistons or traveling valves that open to draw the oil up through the "sucker rods." The piston or valve will rise, creating space in the cavity. On this upstroke, oil fluid will be lifted up. The lifting occurs because the pure fluid is under pressure, and when space is available, the fluid will rise up in an effort to equalize the pressure. The volume of fluid that rises is directly proportional to the pressure.

On the downstroke, the piston or valve is returned back to its lowest position, for drawing fluid into the sucker rods. As the oil rises on the upstroke, the fluid travels Up through the sucker rods for recovery at the surface. Usually, a motor keeps the piston or traveling valve on this continuous stroke motion.

Typically the separator has a capacity that is twice the pump capacity so pump down time is significantly decreased. While certain features have been described in detail herein, it will be understood that the invention encompasses all modifications and enhancements within the scope and spirit of the following claims.

What is claimed is:

1. A downhole gas separator for separating gas from an liquid-gas mixture, said separator comprising:

a. An elongated, tubular pipe having an upper open end and a lower closed end;

b. an elongated radially extending slot in the wall of the pipe;

c. a baffle, axially disposed in the pipe and separating it into two chambers; one chamber being in communication with the slot and the other chamber being in communication with the open end of the pipe; the baffle having a first side surface in one chamber, and a second side surface in the other chamber, wherein said first side surface is rougher than said second side surface.

2. The separator of claim 1, further comprising a second slot adjacent the open end of the pipe and the first slot intermediate of said second slot and the closed end of the pipe.

3. The separator of claim 1, wherein the baffle extends radially between the axially disposed portion of the baffle and the wall of the pipe that includes the slot.

4. The separator in claim 1, further comprising collars on the first and second ends of the tubular pipe.

5. The separator set forth in claim 1, wherein the lower closed end further includes a bull plug.

6. The separator set forth in claim 1, wherein the rougher side surface is in communication with the slot.

7. A downhole gas separator for separating gas from an liquid-gas mixture, said separator comprising:

a. An elongated, tubular pipe having an upper open end and a lower closed end;

b. a first opening in the wall of the pipe;

c. a second opening in the wall of the pipe adjacent the open end of the pipe and the first opening intermediate of said second opening and the closed end of the pipe;

c. an elongated baffle axially disposed in the pipe and separating it into two chambers, a first chamber being in communication with the open end of the pipe and a second chamber being in communication with said first and second openings, wherein said baffle is defined by a first side surface in said first chamber and a second side surface in said second chamber, wherein said second side surface is rougher than said first side surface.

* * * * *